US008838412B2

(12) United States Patent
Shields

(10) Patent No.: US 8,838,412 B2
(45) Date of Patent: Sep. 16, 2014

(54) SYSTEMS AND METHODS FOR PROVIDING WARNING OF ANOMALOUS ALARM CLOCK SETTINGS

(71) Applicant: Google Inc., Mountain View, CA (US)

(72) Inventor: Michael Shields, San Francisco, CA (US)

(73) Assignee: Google Inc., Mountain View, CA (US)

( * ) Notice: Subject to any disclaimer, the term of this patent is extended or adjusted under 35 U.S.C. 154(b) by 58 days.

(21) Appl. No.: 13/652,617

(22) Filed: Oct. 16, 2012

(65) Prior Publication Data

US 2014/0104993 A1 Apr. 17, 2014

(51) Int. Cl.
*G04B 23/02* (2006.01)

(52) U.S. Cl.
CPC ..... *G04B 23/021* (2013.01)
USPC ..... 702/176; 702/179; 702/187

(58) Field of Classification Search
USPC ..... 368/15, 21, 28, 45, 46, 62, 89, 155, 368/244; 702/176, 187, 179
See application file for complete search history.

(56) References Cited

U.S. PATENT DOCUMENTS

| | | | | |
|---|---|---|---|---|
| 2007/0015457 | A1 | 1/2007 | Krampf et al. | |
| 2010/0225495 | A1 * | 9/2010 | Marui | 340/635 |
| 2011/0070757 | A1 | 3/2011 | Krampf et al. | |
| 2011/0130069 | A1 * | 6/2011 | Rollin | 446/297 |
| 2012/0139732 | A1 * | 6/2012 | Smith et al. | 340/573.1 |
| 2013/0163389 | A1 * | 6/2013 | Marhaben | 368/14 |

* cited by examiner

*Primary Examiner* — Michael Nghiem
*Assistant Examiner* — Ivan Rabovianski
(74) *Attorney, Agent, or Firm* — Troutman Sanders LLP; James E. Schutz; Mark Lehi Jones

(57) ABSTRACT

Systems and methods relate to managing an alarm clock function of a device. The systems and methods for compare a time setting of a new alarm by a user to one or more previous times settings that the alarm has been set to determine whether to warn the user about and/or require the user to confirm the time setting of the new alarm. The systems and methods can detect a user input indicating a first time setting for the alarm clock function. Further, the systems and methods can examine the one or more previous time settings associated with the alarm clock function determine, based on the one or more previous time settings, whether to query the user to confirm an activation of the alarm clock function at the first time setting.

20 Claims, 12 Drawing Sheets

300

302 Alarm History 304

| Set Time | Number of Minutes Past Midnight |
|---|---|
| 7:30 AM | 450 |
| 7:30 AM | 450 |
| 7:45 AM | 465 |
| 7:10 AM | 430 |
| 8:10 AM | 490 |

FIG. 3A

310

312 Alarm History 314 316

| When Alarm Was Set | Associated Set Time | Difference in Minutes |
|---|---|---|
| 11:00 PM | 7:15 AM | 495 |
| 10:30 PM | 8:00 AM | 570 |
| 12:05 AM | 6:50 AM | 405 |
| 4:00 PM | 6:00 PM | 120 |
| 11:30 PM | 7:30 AM | 480 |
| 11:15 PM | 8:30 AM | 555 |
| 12:30 AM | 8:45 AM | 495 |
| 11:45 PM | 7:00 AM | 435 |
| 11:20 PM | 7:25 AM | 485 |

FIG. 3B

330

Alarm History

| Interval 1 | Interval 2 | Interval 3 | Interval 4 |
|---|---|---|---|
| 5:50 AM | 6:45 AM | 1:00 PM | 8:00 PM |
| 5:55 AM | 7:00 AM | | 8:30 PM |
| | 7:00 AM | | 9:00 PM |
| | 7:05 AM | | 9:00 PM |
| | 7:05 AM | | |
| | 7:10 AM | | |
| | 7:15 AM | | |
| | 7:20 AM | | |
| | 7:30 AM | | |
| | 7:30 AM | | |
| | 7:35 AM | | |
| | 8:00 AM | | |
| | 8:00 AM | | |
| 10% | 65% | 5% | 20% |

332 334 336 338

340

Frequency (%)

FIG. 3C

SYSTEMS AND METHODS FOR PROVIDING WARNING OF ANOMALOUS ALARM CLOCK SETTINGS

FIELD

This disclosure relates generally to methods and systems for improving alarm clock functionality.

BACKGROUND

Mobile device users often use the alarm clock setting of their mobile devices to set alarms. For example, the users can, in the evening or at night, set an alarm to go off for the next morning. For further example, the users can set a daytime alarm to remind the user of an appointment or obligation. However, in some cases, the user can mistakenly set an alarm. For example, the user can set an alarm for 7:30 PM when a 7:30 AM alarm is intended. In these cases, the alarms will not activate at the intended time, and the user may fail to wake up, miss a meeting, or experience other consequences.

Accordingly, there is a need for to provide methods and systems for reducing occurrences of mistakenly set alarms.

SUMMARY

Implementations of the present teachings relate to computer-implemented methods of managing an alarm clock function of a device. The methods include receiving, at the device, an input indicating a first time associated with the alarm clock function. The methods also include determining whether the first time differs by more than a threshold amount from one or more previous times associated with the alarm clock function. Additionally, the methods include outputting a notification if the first time differs by more than the threshold amount from the one or more previous times.

Implementations of the present teachings also relate to computer readable storage media storing instructions. The instructions cause one or more processor to perform methods. The methods include identifying, at a device, a first time associated with an alarm clock function. The methods also include determining whether the first time differs by more than a threshold amount from one or more previous times associated with the alarm clock function. The methods also include outputting a notification if the first time differs by more than the threshold amount from the one or more previous times.

Implementations of the present teachings also relate devices for managing an alarm clock function. The devices include one or more memory devices storing instructions, and one or more processors coupled to the one or more memory devices. The one or more processors are configured to execute the instructions to perform methods. The methods include receiving an input indicating a first time associated with the alarm clock function. The methods also include determining whether the first time differs by more than a threshold amount from one or more previous times associated with the alarm clock function. Additionally, the methods include outputting a notification if the first time differs by more than the threshold amount from the one or more previous times.

BRIEF DESCRIPTION OF THE DRAWINGS

Various features of the implementations can be more fully appreciated, as the same become better understood with reference to the following detailed description of the implementations when considered in connection with the accompanying figures, in which:

FIGS. 3A-3C are generic diagrams for examples of alarm histories, according to various implementations.

DETAILED DESCRIPTION

For simplicity and illustrative purposes, the principles of the present teachings are described by referring mainly to examples of various implementations thereof. However, one of ordinary skill in the art would readily recognize that the same principles are equally applicable to, and can be implemented in, all types of information and systems, and that any such variations do not depart from the true spirit and scope of the present teachings. Moreover, in the following detailed description, references are made to the accompanying figures, which illustrate specific examples of various implementations. Electrical, mechanical, logical and structural changes can be made to the examples of the various implementations without departing from the spirit and scope of the present teachings. The following detailed description is, therefore, not to be taken in a limiting sense and the scope of the present teachings is defined by the appended claims and their equivalents.

Implementations of the present teachings relate to systems and methods for managing an alarm clock function of a device. More particularly, implementations relate to systems and methods for comparing a time setting of a new alarm by a user to one or more previous time settings that the alarm has been set to determine whether to warn the user about and/or require the user to confirm the setting of the new alarm time. An alarm application and/or associated logic or services of a device can detect a user input indicating a first time setting for the alarm clock function. Further, the alarm application and/or associated logic or services can examine the one or more previous time settings associated with the alarm clock function and determine, based on the one or more previous time settings, whether to query the user to confirm an activation of the alarm clock function at the first time setting.

These and other implementations described herein provide a device user with an opportunity to confirm a potentially mistakenly set alarm time. Users may therefore avoid consequences associated with a mistakenly set alarm time such as, for example, failing to wake up, missing a meeting or appointment, failing to be reminded of an occurrence, and/or other consequences.

Figure 1A:
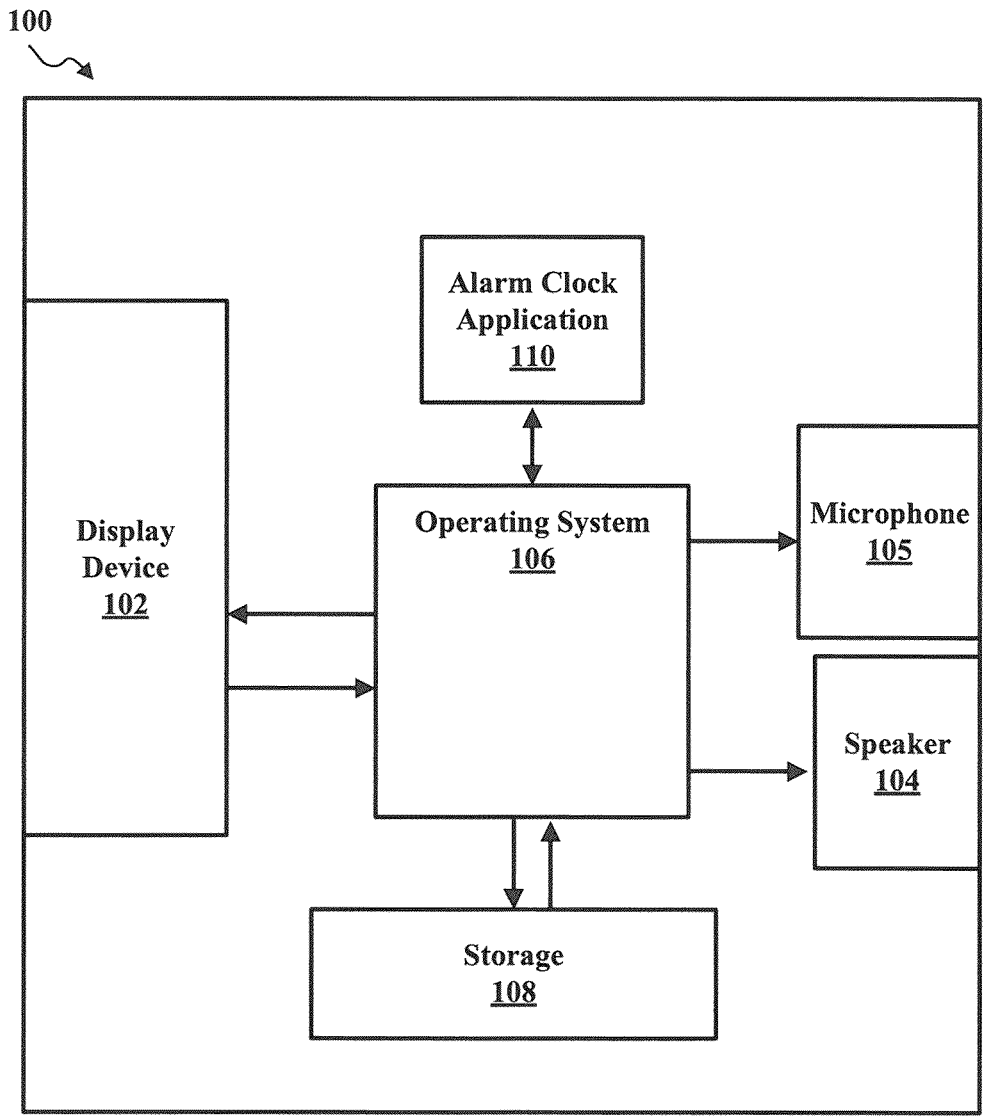
FIG. 1A is a generic block diagram that illustrates a device for performing alarm clock functions, according to various implementations.
Figure 1B:
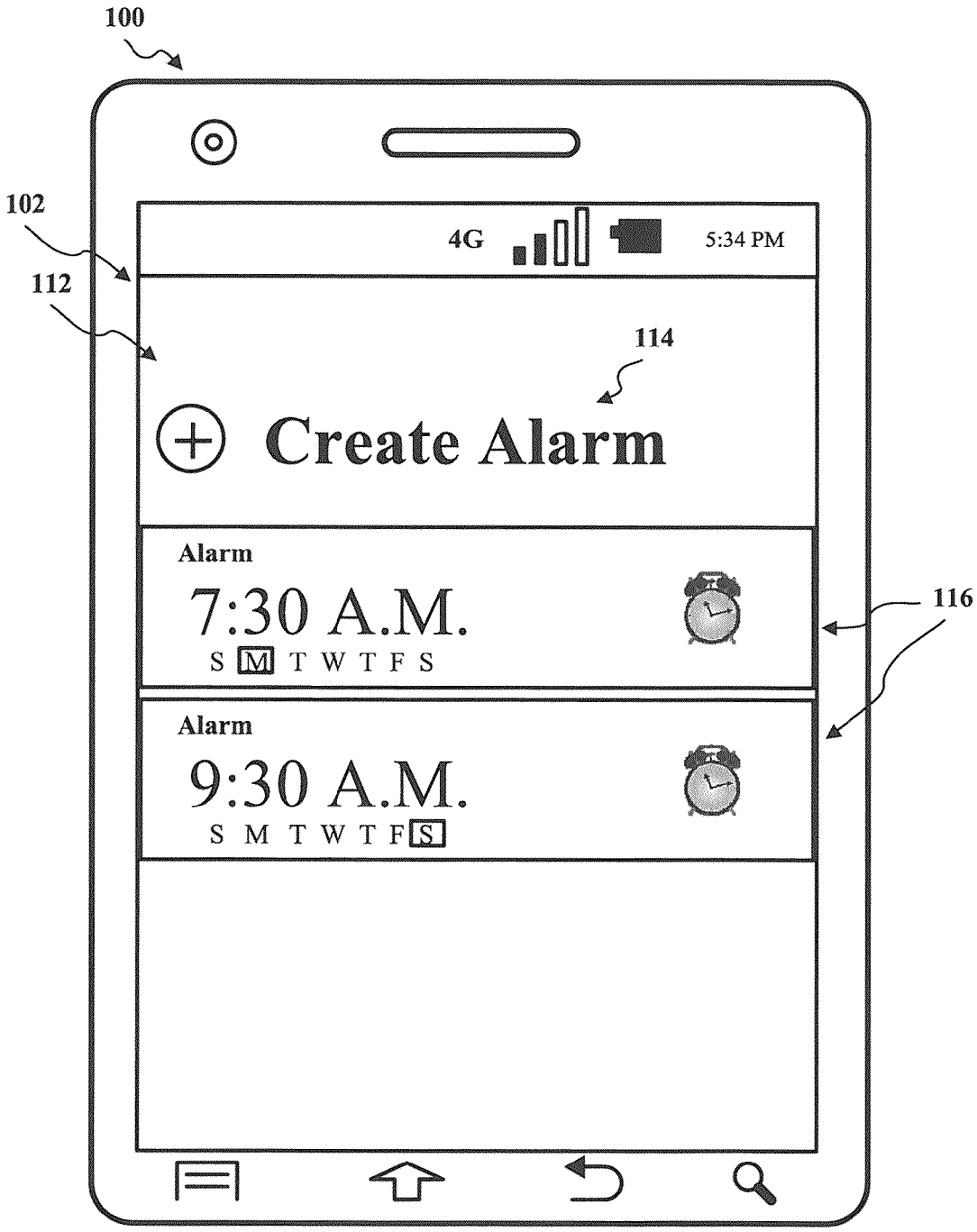
FIGS. 1B and 1C are front views of the device that illustrate various interfaces for an alarm clock application, according to various implementations.
Figure 1C:
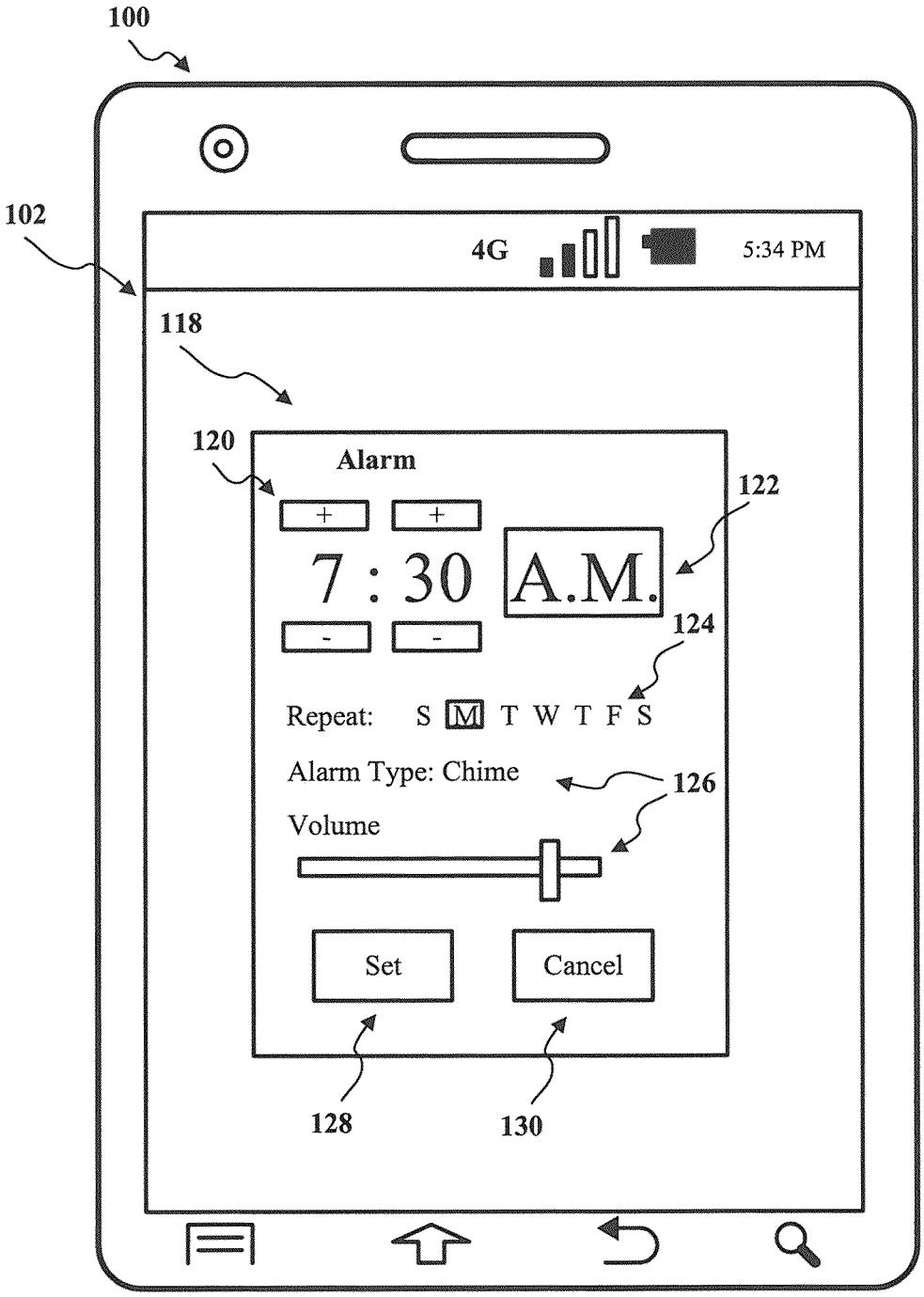

FIGS. 1A, 1B, and 1C illustrate an example of a device 100 for supporting and facilitating the systems and methods for managing alarm clock functions, according to various implementations. While FIGS. 1A, 1B, and 1C illustrate various components or parts contained in the device 100, FIGS. 1A, 1B, and 1C illustrate one example of the device 100 and additional components can be added and existing components can be removed.

FIG. 1A shows examples of components and parts that can be included in the device 100. The device 100 can be any type of electronic or computing device that is capable of supporting alarm clock functions. For example, the device can be a smart cellular telephone ("smart phone"), a cellular telephone ("cell phone"), a tablet computing device ("tablet computer"), a laptop computing device ("laptop computer"), a personal data assistant ("PDA"), a desktop computing device ("desktop computer"), an electronic alarm clock, and any other type of electronic device capable of performing alarm clock functions.

As illustrated in FIG. 1A, the device 100 can include a display 102. The display 102 can be configured to display information output from the device 100. The display 102 can also be configured to receive input from a user of the device 100. In implementations, the display 102 can be a touch screen display of any type, such as, for example, an LED, LCD, CRT, plasma, electrostatic imaging, or any other type of display that can be configured to display images and receive input by interaction with a user. Various other types of input-capturing screens can be used for the display 102, e.g., voice-activated screens, screens cooperating with optical sensors configured to track/register movement of a user, stylus, pointer, etc., without necessarily relying on anything touching the display 102. In some implementations, the display 102 can be a projection onto an external surface, and the user may interact with the projected images to provide input to the device 100. For purposes of illustration, however, display 102 will be described herein as a touch screen display, but is not to be considered limiting, unless otherwise expressly stated herein.

The device 100 can also include a speaker 104. The speaker 104 can be configured to emit audible sound from the device 100. The speaker 104 can be any type of hardware, software, and combination thereof that is configured to produce sound emitted from the device 100. The device 100 can also include a microphone 105. The microphone 105 can be configured to capture and input sound into the device 100. The microphone 105 can be any type of hardware, software, and combination thereof that is configured to capture and input sound into the device 100.

The device 100 can also include an operating system 106. The operating system 106 can be configured to provide an execution environment on the device 100. For example, the operating system 106 can provide an execution environment for one or more application programs that can be stored and executed on the device 100. The operating system 106 can provide services to the one or more application programs to access, utilize, and interact with the components of the device 100, such as the display 102, the speaker 104, and storage 108. The operating system 106 can be any type of open-source or propriety operating system. The one or more applications programs can include, for example, a word-processing application, a web-browser, browser-implemented application, messaging application, electronic mail application, or the like.

The device 100 can also include one or more types of storage 108. The storage 108 can be any type of storage that provides permanent storage and/or temporary storage in the device 100. The storage 108 can be configured to store copies of software programs such as the operating system 106 and the one or more applications programs. The storage 108 can also be configured to store data and information used and accessed by the operating system 106 and the one or more applications programs. The device 100 can also utilize remote storage via one or more networks accessible by the device 100. The remote storage can be any type of storage that is accessible by the device 100 such as remote server computers, "cloud" storage, and the like. The remote storage can store any of the software programs used by the device 100 and any of the data and information used and accessed by the operating system 106 and the one or more applications programs.

In implementations, the device 100 can include an alarm clock application 110. The alarm clock application 110 can be configured to perform the alarm clock functions as described herein. As described herein, alarm clock functions refer to processes and procedures for specifying a time at which the device 100 will provide an alarm, for example an audible sound emitted from the speaker 104, a physical indication by the device 100 (e.g. vibrating of the device 100) and/or a visual indication from the display 102 (e.g. flashing indication from the display 102), indicating that the time has been reached. The alarm clock application 110 can be a standalone application program that is configured to perform the alai in clock functions. Likewise, the alarm clock application 110 can be a program module that is part of another application or program, such as the operating system 106. The alarm clock application 110 can be implemented as software, hardware, or combination of both.

To allow users to utilize the alarm clock functions, the alarm clock application 110 can be configured to generate and output an interface. The interface can be any type of interface such as a graphical user interface (GUI) and/or command-line interface that allows a user to interact with the alarm clock application. For example, FIG. 1B shows a front view of the device 100 in which an example of an interface 112 is displayed on the display 102. As illustrated, the interface 112 can include various widgets, text boxes, and other fields that allow a user to create an alarm, view existing alarms, and modifying existing alarms. For instance, the interface 112 can include a widget 114 that allows a user to create a new alarm. The interface 112 can also include widgets 116 that allow a user to view and modify existing alarms. As illustrated, the widgets 116 can display the current settings of the existing alarms, such as date and time and whether the alarm is enabled. By selecting, the widgets 116 the user can modify the existing alarm.

Additionally, for example, FIG. 1C shows a front view of the device 100 in which an example of an interface 118 is displayed on the display 102. As illustrated, the interface 118 can include various widgets, text boxes, and other fields for setting and initiating an alarm clock function configured to execute on the device 100. For instance, the alarm clock application 110 can generate and display the interface 118 in response to a user selecting the widget 114 or widgets 116 in the interface 112. The interface 118 can include a widget 120 that allows the user to input a time associated with a desired alarm. Further, the interface 118 can include a widget 122 that allows the user to specify either AM or PM when setting the alarm. The interface 118 can include a widget 124 that allows the user to select the day on which the alarm will be active. The interface 118 can include other widgets 126 that allow the user to select other parameters such as the type and volume of audible sound played when the alarm clock function is activated. In addition, the interface 118 can include a set button 128 that allows the user to set the alarm and a cancel button 130 that allows the user to cancel the alarm.

In implementations, in addition to interfaces, the alarm clock application 110 can be controlled by other channels. For example, the alarm clock application 110 can be configured to be controlled by voice commands. As such, the alarm clock application 110 can be configured to receive sound input into the microphone 105 and interpret the sounds in order to create an alarm, view existing alarms, and modifying existing alarms. Likewise, the alarm clock application 110 can be controlled by other software programs. As such, the alarm clock application 110 can be configured to receive commands via interfaces such as application programming interfaces (APIs).

In implementations, the alarm clock application 110 can determine whether the user may have mistakenly set the alarm. For example, the user could have mistakenly selected P.M. while intending the alarm to go off in the morning, e.g. A.M. For further example, the user could have mistakenly set a time that is significantly later than a time the user normally sets. Further, for example, the user could have set a time for a day of the week that is inconsistent with alarms that were previously set for that particular day of the week. It should be appreciated that other scenarios are envisioned. In implementations, the alarm clock application 110 as described herein can analyze or examine an alarm history associated with the device to determine whether the user may have mistakenly set the alarm. More particularly, the alarm history can comprise a listing of one or more previous times that the alarm clock function has been set.

In implementations, the alarm clock application 110 can store the alarm history in any type of storage accessible by the device 100. For example, the alarm clock application 110 can store the alarm history in the storage 108. Likewise, the alarm clock application 110 can store the alarm history in remote storage such as remote server computers, "cloud" storage, and the like.

FIGS. 2A-2D illustrate an example of processes that can be performed by the alarm clock application 110 to determine whether a user may have mistakenly set the alarm, according to various implementations. While FIGS. 2A-2D illustrate various processes that can be performed by the alarm clock application 110, any of the processes and stages of the processes can be performed by any component of the device 100. Likewise, the illustrated stages of the processes are examples and that any of the illustrated stages can be removed, additional stages can be added, and the order of the illustrated stages can be changed.

In 202, the process can begin. In 204, the alarm clock application 110 can be initiated. The alarm clock application 110 can be initiated by a user interacting with the device 100. For example, a user of the device 100 can initiate the alarm clock application 110 from a home screen of the device, via a keystroke sequence, or via other channels.

In 206, the alarm clock application 110 can generate and output an interface that allows a user to set an alarm. The alarm clock application 110 can generate an interface that allows the user to create a new alarm or modify an existing alarm and pass the interface to the display 102 for viewing by the user. For instance, the alarm clock application 110 can generate an interface 112 and/or 118 as described above.

In 208, the alarm clock application 110 can receive input that indicates the parameters of the current alarm to be set. The parameters received can include a time and date for the current alarm and other parameters such as type and volume of an audible sound to be emitted upon the occurrence of the alarm. The alarm clock application 110 can receive the input from the user via the interfaces displayed on the display 102.

Figure 2A:
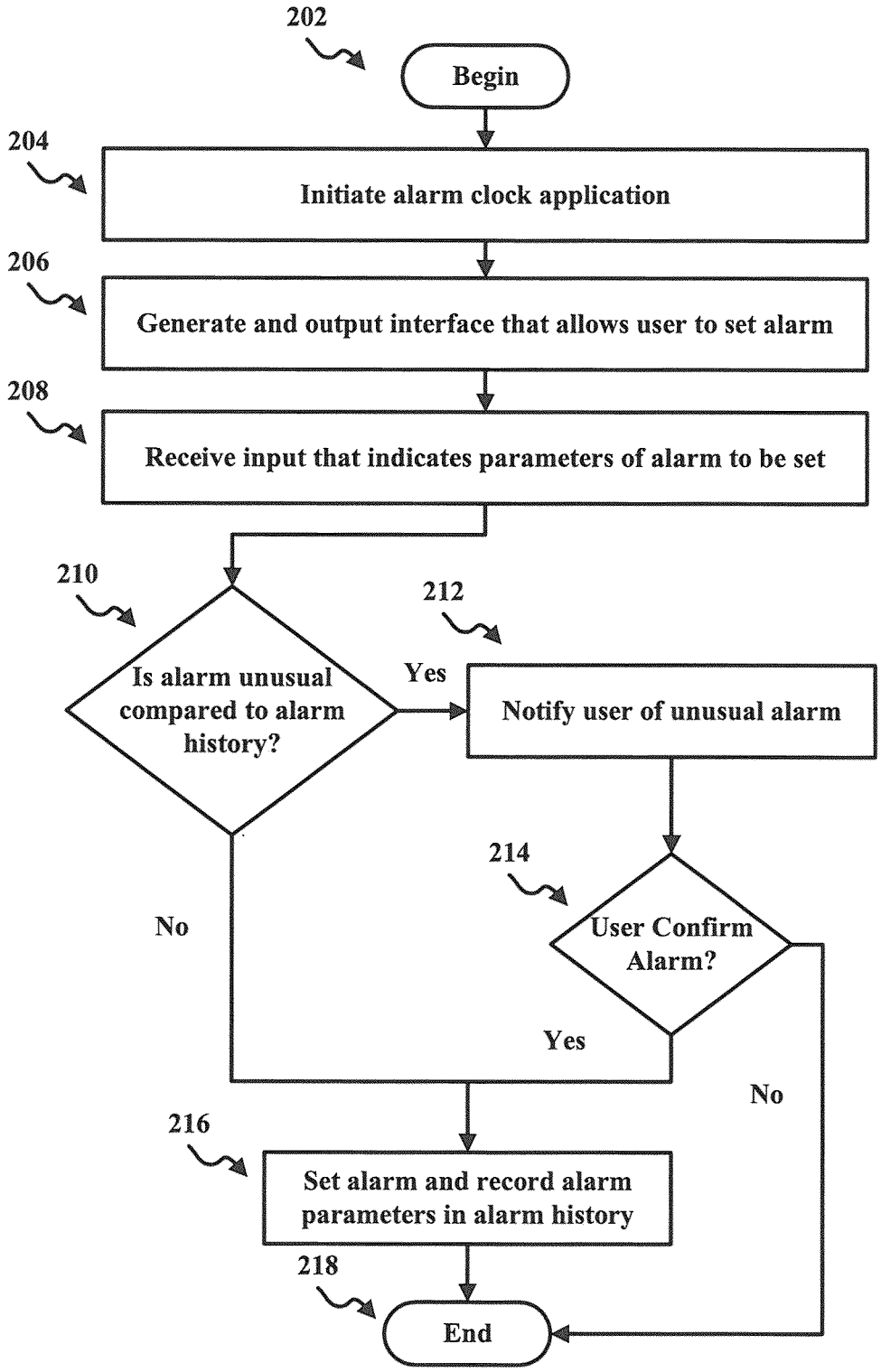
FIGS. 2A-2D are flow diagrams that illustrate examples of processes for determining whether an alarm is usual or unusual, according to various implementations.
Figure 2B:
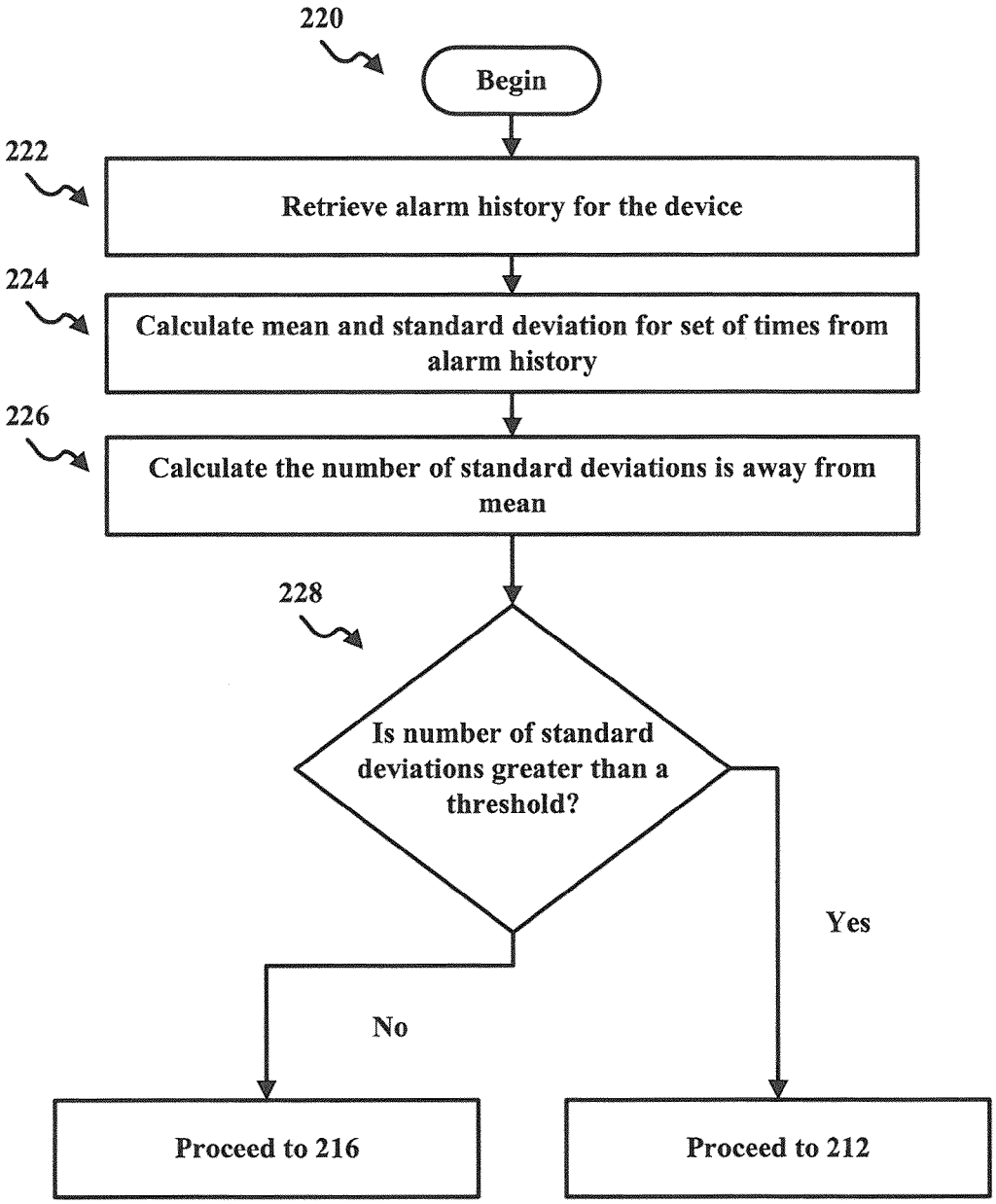
Figure 2C:
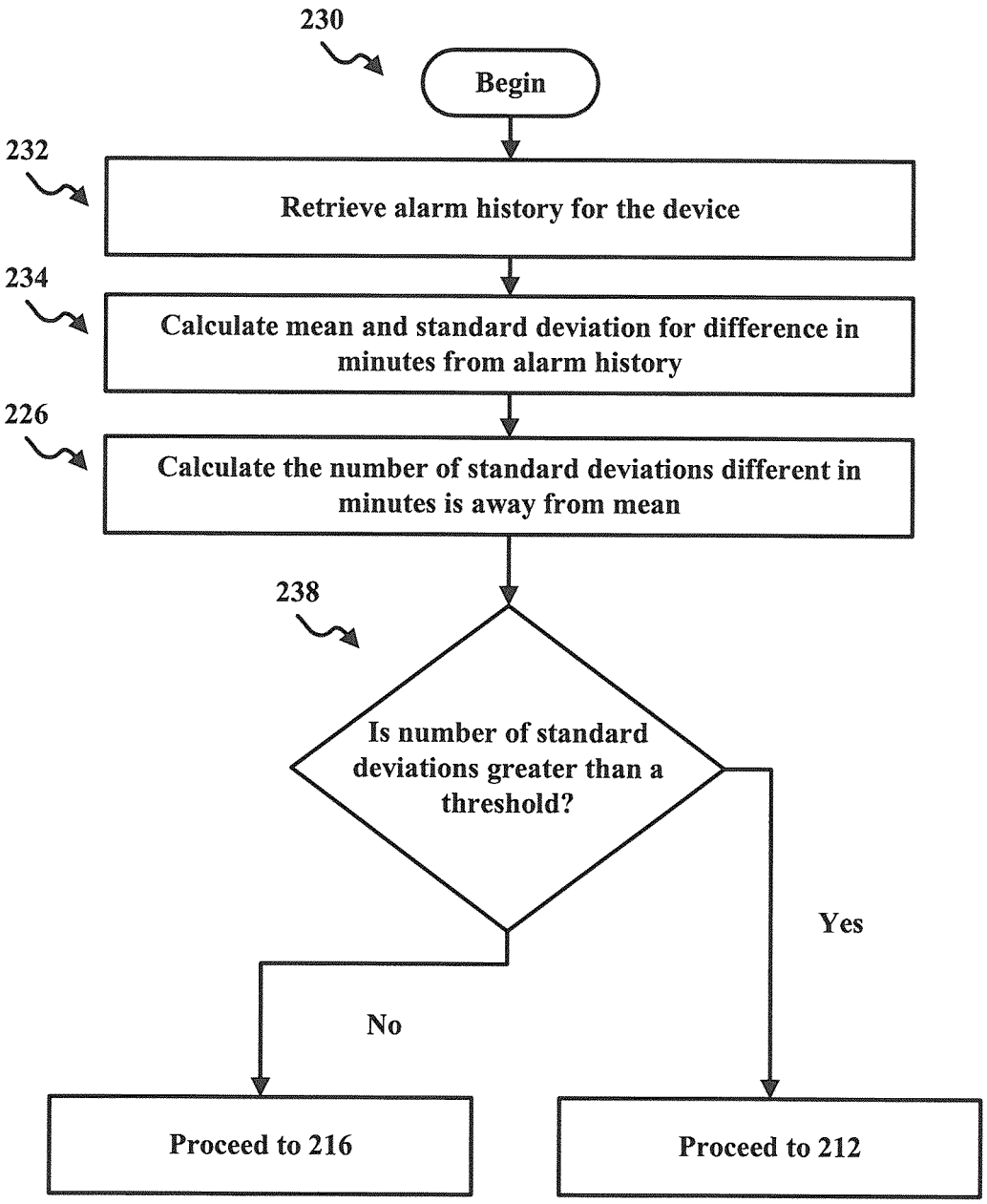
Figure 2D:
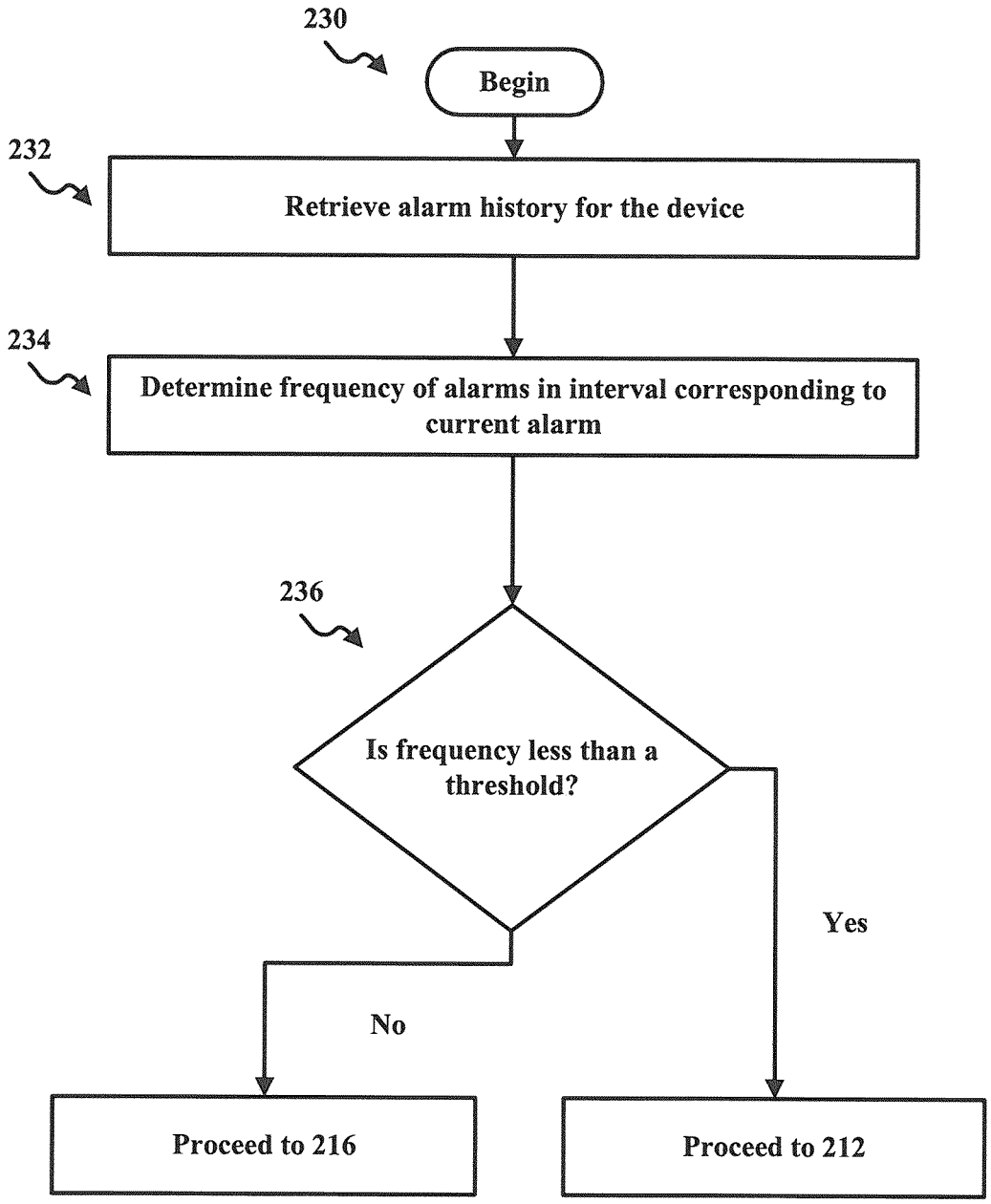

In 210, the alarm clock application 110 can determine whether the alarm parameters for the current alarm are unusual compared to previously-set alarms. The alarm clock application 110 can access an alarm history and retrieve the parameters of previously-set alarms, such as time and date. The alarm clock application 110 can compare the parameters of the current alarm to the previously-set alarms and utilize various mathematical and statistical methods to determine whether the current alarm is unusual compared to the previously-set alarms from the alarm history. FIGS. 2B, 2C, and 2D illustrate three examples of processes that the alarm clock application 110 can utilize to determine if the alarm is unusual. In implementations, the alarm clock application 110 can utilize the example processes, separately, to determine if the alarm is unusual. Likewise, the alarm clock application 110 can utilize the example processes, in combination, to determine if the alarm is unusual.

FIG. 2B shows an example of comparing the current alarm to the alarm history based on mean and standard deviation. In 220, the process can begin. In 222, the alarm clock application 110 can retrieve an alarm history for the device 100. The alarm history can store a record of all of the alarms that have been set on the device 100 or can represent the last "n" times that the alarm was set (e.g., n=5). The alarm history can correspond to some or all alarms set in a particular interval. For example, the alarm history can detail alarms that have been set on the device for the last "n" Mondays. It should be appreciated that the alarm history can correspond to other intervals or frequencies associated with the alarm clock function.

FIG. 3A illustrates an example of an alarm history 300, according to various implementations. The alarm history 300 can detail a set of times 302 associated with alarms that were previously set on the device 100. For example, the set of times 302 for previously-set alarms of the device 100 were 7:30 AM, 7:30 AM, 7:45 AM, 7:10 AM, and 8:10 AM. Additionally, the alarm history 300 can include a set of values 304 that details number of minutes past midnight for each alarm in the set of times 302. For example, the 7:30 AM alarm is 450 minutes past midnight, the 7:45 alarm is 465 minutes past midnight, and so on.

In 224, the alarm clock application 110 can determine a mean and a standard deviation of the number of minutes past midnight for each previously-set alarm in the alarm history. The alarm clock application 110 can utilize the following equation to calculate the mean:

$$\bar{x} = \frac{1}{n} \times \sum_{i=1}^{n} x_i$$

where $\bar{x}$ is the mean, n is the number of previously-set alarms and $x_i$ is the number of minutes past midnight for each of the previously-set alai ins. The alarm clock application 110 following equation to calculate the standard deviation:

$$\sigma = \sqrt{\frac{\sum_{i=1}^{n} (x_i - \bar{x})^2}{n}}$$

where $\sigma$ is the standard deviation, $\bar{x}$ is the mean, n is the number of previously-set alarms and $x_i$ is the number of minutes past midnight for each of the previously-set alarms.

For example, the mean is 457 minutes and the standard deviation is 20.3 for the alarm history 300. It should be appreciated that other techniques for calculating a mean and standard deviation of the previously-set alarms in the alarm history are envisioned. For example, instead of calculating the mean and standard deviation from the number of minutes past midnight, the mean and standard deviation can be calculated from a number of minutes from noon, or from other benchmarks.

In 226, the alarm clock application 110 can calculate the number of standard deviations the current alarm is from the mean of the previously-set alarms. For example, using the alarm history 300, if an 8:00 AM alarm is attempted to be set by the user, the alarm clock application 110 can determine that the alarm is 1.13 standard deviations away from the mean. If a 9:00 AM alarm is attempted to be set by the user, the alarm clock application 110 can determine that the alarm is 4.01 standard deviations away from the mean. If a 7:00 PM alarm is attempted to be set by the user, the alarm clock application 110 can determine that the alarm is 33.6 standard deviations away from the mean.

In 228, the alarm clock application 110 can compare the calculated standard deviations to threshold values to determine if the alarm attempted to be set can be construed as usual, unusual, very unusual, or other classification conventions. It should be appreciated that any threshold values as well as classification conventions can be incorporated in the systems and methods as described herein. For example, a usual alarm can be considered an alarm that is between 0 and 2 standard deviations away from the mean, an unusual alarm can be considered an alarm that is between 2 and 5 standard deviations away from the mean, and a very unusual alarm can be considered an alarm that is over 5 standard deviations away from the mean.

For instance, referring to the above examples, if the alarm is 1.13 standard deviations away from the mean, the alarm clock application 110 can determine that the alarm is a usual alarm. If the alarm is 4.01 standard deviations away from the mean, the alarm clock application 110 can determine that the alarm is an unusual alarm. If the alarm is 33.6 standard deviations away from the mean, the alarm clock application 110 can determine that the alarm a very unusual alarm. If the alarm clock application 110 determines that the alarm is usual, the alarm clock application can proceed to 216. If the alarm clock application 110 determines that the alarm is unusual, the alarm clock application can proceed to 212.

FIG. 2C shows another example of determining whether the current time is unusual. In particular, the alarm clock applications 110 can compare the current alarm to the alarm history based on an amount of time between when a proposed alarm is being set and the actual set time of the proposed alarm. In 230, the process can begin. In 232, the alarm clock application can retrieve an alarm history for the device 100. FIG. 3B illustrates another example of an alarm history 310, according to various implementations. As illustrated, the alarm history 310 can include a plurality of associated set times 312 of alarms that were previously set on the device, as well as a plurality of times 314 at which the corresponding alarms were set. Further, the alarm history 310 also includes a difference in minutes 316 between the plurality of associated set times 312 and the plurality of times 314. For example, the 7:15 AM alarm was set at 11:00 PM, a difference of 495 minutes; the 8:00 AM alarm was set at 10:30 PM, a difference of 570 minutes; and so on.

In 234, the alarm clock application 110 can calculate a mean and a standard deviation of the difference in minutes. The alarm clock application 110 can calculate the mean and standard deviation utilizing the equations described above. For example, referring to the difference in minutes 316 from the alarm history 310 in FIG. 3B, the mean is 449 minutes and the standard deviation is 133.6.

In 236, the alarm clock application 110 can calculate the number of standard deviations the difference in minutes for the current alarm is from the mean of the previously-set alai ins. For example, referring to alarm history 310, if the user is proposing, at 11:20 PM, to set an alarm for 7:15 AM (475 minutes), then the alarm clock application 110 can calculate that 475 is 0.23 standard deviations away from the mean. Further, for example, if the current alarm is 300 minutes after the current alarm is set, then the alarm clock application 110 can calculate that 300 is 1.31 standard deviations away from the mean. If the current alarm is 1200 minutes after the current alarm is set, then the alarm clock application 110 can calculate that 1200 is 5.62 standard deviations away from the mean.

In 238, the alarm clock application 110 can compare the standard deviations for the current alarm to threshold values to determine if the proposed alarms can be construed as usual, unusual, very unusual, or other classification conventions. For example, a usual alarm can be considered an alarm that is between 0 and 1 standard deviations away from the mean, an unusual alarm can be considered an alarm that is between 1 and 3 standard deviations away from the mean, and a very unusual alarm can be considered an alarm that is over 3 standard deviations away from the mean.

For example, referring to above examples, if the current alarm is 0.23 standard deviations away from the mean, the alarm clock application 110 can determine a usual alarm. If the current alarm is 1.31 standard deviations away from the mean, the alarm clock application 110 can determine an unusual alarm. If the current alarm is 5.62 standard deviations away from the mean, the alarm clock application 110 can determine a very unusual alarm. If the alarm clock application 110 determines that the alarm is usual, the alarm clock application can proceed to 216. If the alarm clock application 110 determines that the alarm is unusual, the alarm clock application can proceed to 212.

FIG. 2D shows another example of determining whether the current time is unusual. In particular, the alarm clock application 110 can compare the current alarm to the alarm history based on dividing the times available for setting an alarm into intervals, and examining a frequency at which a time in each interval is selected. In 240, the process can begin. In 242, the alarm clock application 110 can retrieve an alarm history for the device 100. FIG. 3C illustrates another example of an alarm history 330, according to various implementations. As illustrated, the 24 hour day can be divided into four (4) 6-hour intervals. More particularly, "Interval 1" 332 can list alarms set in the 12:00 AM-6:00 AM interval, "Interval 2" 334 can list alarms set in the 6:00 AM-12:00 PM interval, "Interval 3" 336 can list ala ins set in the 12:00 PM-6:00 PM interval, and "Interval 4" 338 can list alarms set in the 6:00 PM-12:00 AM interval. Additionally, a frequency row 340 can list a frequency at which a previously-set alarm is in a particular interval (e.g., "Interval 2" 410 includes 65% of the previously-set alarms).

In 244, the alarm clock application 110 can determine the frequency of previously-set alarms in the interval corresponding to the current alarm. For example, if the user attempts to set an alarm for 7:30 PM (Interval 4), then the alarm clock application 110 can examine the alarm history 330 and can determine that only 20% of previously-set alarms have been set in Interval 4.

In 246, the alarm clock application 110 can determine if the frequency is less than a threshold value. For example, if the current alarm is 7:30 PM, the alarm clock application 110 can determine the frequency is 20% which is less than a threshold value for a usual alarm. For further example, if the user attempts to set an alarm for 7:30 AM (Interval 2), then the application or logic can determine that 65% of previously-set alarms have been set in Interval 2, can determine that 65% meets or exceeds a threshold value for a usual alarm. If the alarm clock application 110 determines that the alarm is usual, the alarm clock application 110 can proceed to 216. If the alarm clock application 110 determines that the alarm is unusual, the alarm clock application can proceed to 212.

In some implementations, the alarm clock application 110 can determine alarms that are usual or unusual based on the day of the week on which previous alarms have been set or not set. More particularly, an alarm history of the alarm clock function can be examined to determine the day of the week (e.g., Monday, Tuesday, etc.) on which the alarms of the alarm history were set. Similar to the functionality as discussed with respect to FIG. 2D, the alarm clock application 110 can determine frequencies associated with the ala is. For example, the alarm history can indicate that alarms have been set on 95% of the previous "n" Mondays, 98% of the previous "n" Tuesdays, 15% of the previous "n" Sundays, and so on. If on a Saturday night there is an alarm set for Sunday morning and the Sunday morning alarm frequency is 5%, and the threshold is under 10%, then the alarm clock application 110 can notify the user that there is a currently-set Sunday alarm, and can prompt the user to confirm the alarm.

In 212, if the alarm clock application 110 determines that the current alarm is unusual, the alarm clock application 110 can notify the user that the current alarm is unusual. The alarm clock application 110 can provide any type of notification that informs the user that the current alarm is unusual. For example, the alarm clock application 110 can provide a visual notification on the display 102 and/or an audible notification emitted from the speaker 104.

Figure 4A:
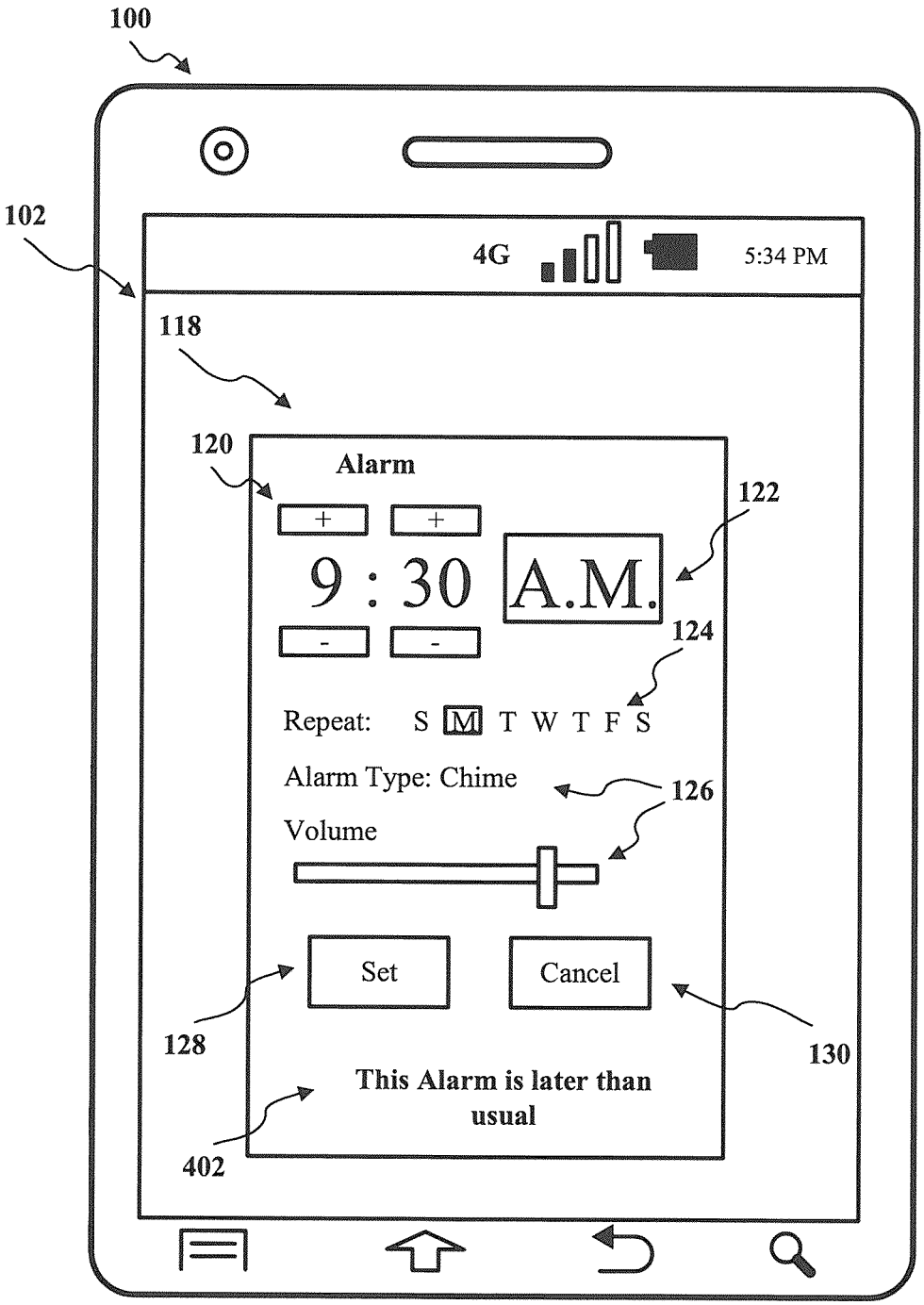
FIGS. 4A and 4B are front views of the device that illustrate examples of notifications, according to various implementations.
Figure 4B:
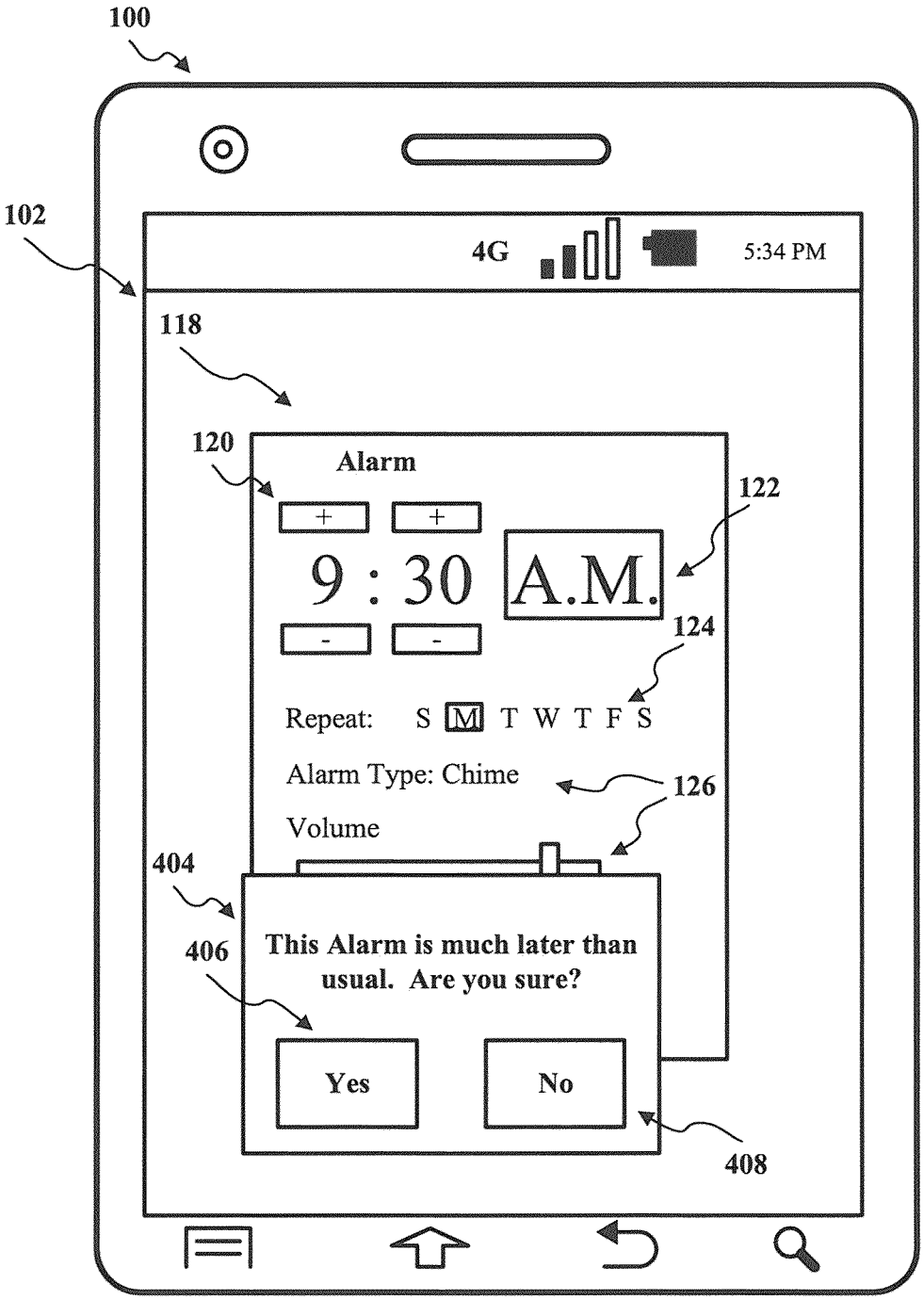

FIGS. 4A and 4B illustrate two examples of notifications that can be provided to the user, according to various implementations. As illustrated in FIG. 4A, the alarm clock application can modify the interface 118 to include a text notification 402 that indicates that the current alarm is "later" (or "earlier" depending on the current alarm) compared to previously-set alarms. As illustrated in FIG. 4B, the alarm clock application can generate and display a new interface such as text box 404. The text box 404 can include confirmation buttons 406 and 408 that allow the user to confirm or decline the current alarm.

The particular type of notification can depend on the degree of unusualness based on the threshold. More particularly, interface can display "LATE" or other indications that can inform the user of the potential unusualness of the alarm that is attempting to be set. The determination of the degree to which the attempted alarm is usual/unusual can be made upon the user entering the time of the alarm, upon the user setting the alarm, and/or at other times or stages. For example, if the current alarm is determined to be unusual, the alarm clock application 110 can provide the text notification 402 in the interface 402, as illustrated in FIG. 4A. If the current alarm is determined to be very unusual, the alarm clock application can provide text box 404 which requires the user to confirm or decline the "much later" (or "much earlier") alarm.

In 214, the alarm clock application 110 can receive a confirmation from the user that the alarm is correct. The confirmation can be received via any of the interfaces provided by the alarm clock application 110. If the user confirms the current alarm, the alarm clock application 110 proceeds to 216. If the user declines the current alarm, the alarm clock application 110 proceeds to 218.

In 216, the alarm clock application 110 can set the current alarm and store the parameters of the current alarm in the alarm history. In 218, the process can end, return to any point or repeat.

In the processes described above, the alarm clock application 110 can notify a user attempting to set a current alarm that the alarm is unusual. Likewise, using similar processes described above, the alarm clock application 110 can utilize the alarm history to notify a user if an alarm that is usual set at a time and date is not current set. The alarm clock application 110 can examine the alarm history and determine the date and times alarms are typically set and notify a user if the alarm is not current set. For example, the alarm clock application 110 can examine the weekday alarm frequencies to determine whether to notify the user about unset alarm. More particularly, the alarm clock application 110 can compare the frequencies to established thresholds to determine whether to provide the notification. For example, if on a Monday night there is no currently-set alarm for Tuesday morning when the Tuesday morning alarm frequency is 95%, and the threshold is 90%, the alarm clock application 110 can notify the user that there is no Tuesday alarm currently set, and can prompt the user to set a Tuesday alarm. It should be appreciated that alternative anomalous alarm clock notifications are envisioned.

In the examples of the processes described above, the alarm clock application 110 can be initiated and controlled using an interface displayed on the display 102. In other examples of the processes described above, the alarm clock application 110 can be initiated and controlled using other channels. For example, the alarm clock application 110 can be configured to be controlled by voice commands. As such, the alarm clock application 110 can be configured to receive sound input into the microphone 105 and interpret the sounds in order to create an alarm, view existing alarms, and modifying existing alarms. Likewise, the alarm clock application 110 can be controlled by other software programs. As such, the alarm clock application 110 can be configured to receive commands via interfaces such APIs.

In the examples of the processes described above, the alarm clock application 110 can provide a notification that includes text indicating that an alarm may be anomalous. In other examples of the processes described above, the alarm clock application 110 can utilize any type of notification indicating that an alarm may be anomalous. For example, the alarm clock application 110 can provide other visual indications such as a flashing indication on the display 102. Additionally, for example, the alarm clock application 110 can generate and emit from the speaker 106 an audible notification that the alarm may be anomalous. Also, for example, the alarm clock application 110 can provide a physical notification such as vibration in the device 100. Any of the notification described above can be used in combination or separately.

Figure 5:
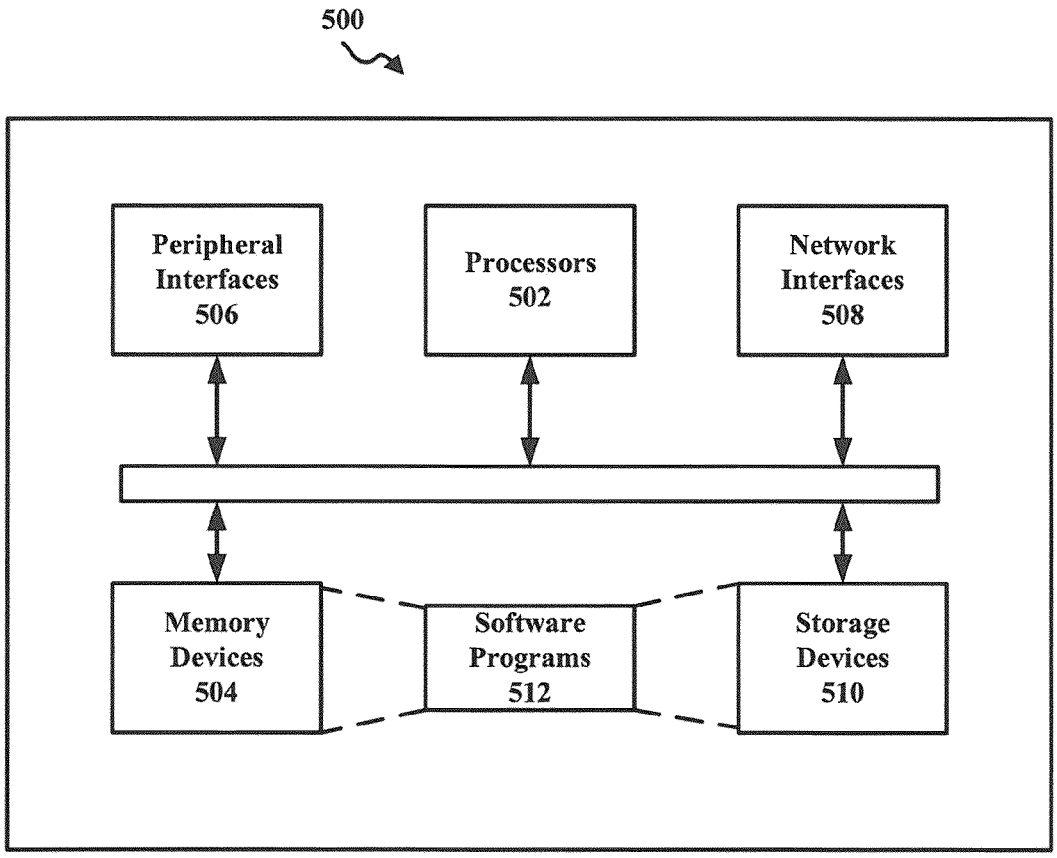
FIG. 5 is a block diagram of an example of components of a device, according to various implementations.

FIG. 5 is a diagram depicting an example of a hardware configuration for a device 500, such as the device 100, that can be used to perform one or more of the processes described above. While FIG. 5 illustrates various components contained in the device 500, FIG. 5 is one example of a device and that additional components can be added and existing components can be removed.

As illustrated in FIG. 5, the device 500 can include one or more processors 502 of varying core configurations and clock frequencies. The device 500 can also include one or more memory devices 504 that serve as a main memory during the operation of the computing device 400. The device 500 can also include one or more peripheral interfaces 506, such as keyboards, mice, touchpads, computer screens, touchscreens, etc., for enabling human interaction with and manipulation of the device 500.

The device 500 can also include one or more network interfaces 508 for communicating via one or more networks, such as Ethernet adapters, wireless transceivers, or serial network components, for communicating over wired or wireless media using protocols, such as Ethernet, wireless Ethernet, Global System for Mobile Communications (GSM), Enhanced Data rates for GSM Evolution (EDGE), Universal Mobile Telecommunications System (UMTS), Worldwide Interoperability for Microwave Access (WiMAX), Long Term Evolution (LTE), etc. The device 500 can also include one or more storage device 510 of varying physical dimensions and storage capacities, such as flash drives, hard drives, random access memory, etc., for storing data, such as images, files, and program instructions for execution by the one or more processors 502.

Additionally, the device 500 can include one or more software programs 512, such as the operating system 106 and the alarm clock application 110. The one or more software programs 512 can include instructions that cause the one or more processors 502 to perform the processes described. The one or more software programs can be stored in the one or more memory devices 504 and/or on in the one or more storage devices 510, which correspond to the storage 108 described above.

In implementations, the components of the device 500 need not be enclosed within a single enclosure or even located in close proximity to one another. Those skilled in the art will appreciate that the above-described componentry are examples only, as the device 500 can include any type of hardware componentry, including any necessary accompanying firmware or software, for performing the disclosed implementations. The device 500 can also be implemented in part or in whole by electronic circuit components or processors, such as application-specific integrated circuits (ASICs) or field-programmable gate arrays (FPGAs).

In situations in which the systems and methods discussed here store or share data of the user's computing device, the data can be treated in one or more ways before it is stored or used, so that personally identifiable information is removed. For example, a user's identify can be treated so that no personally identifiable information can be determined for the user, or a user's geographic location can be generalized where location information is shared, so that a particular location of a user cannot be determined. Thus, the user can have control over how data, about the user, is collected, stored, or shared.

Certain implementations described above can be performed as a computer applications or programs. The computer program can exist in a variety of forms both active and inactive. For example, the computer program can exist as one or more software programs, software modules, or both that can be comprised of program instructions in source code, object code, executable code or other formats; firmware program(s); or hardware description language (HDL) files. Any of the above can be embodied on a computer readable medium, which include computer readable storage devices and media, and signals, in compressed or uncompressed form. Examples of computer readable storage devices and media include conventional computer system RAM (random access memory), ROM (read-only memory), EPROM (erasable, programmable ROM), EEPROM (electrically erasable, programmable ROM), and magnetic or optical disks or tapes. Examples of computer readable signals, whether modulated using a carrier or not, are signals that a computer system hosting or running the present teachings can be configured to access, including signals downloaded through the Internet or other networks. Concrete examples of the foregoing include distribution of executable software program(s) of the computer program on a CD-ROM or via Internet download. In a sense, the Internet itself, as an abstract entity, is a computer readable medium. The same is true of computer networks in general.

While the teachings have been described with reference to examples of the implementations thereof, those skilled in the art will be able to make various modifications to the described implementations without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Further, unless specified otherwise, the term "set" should be interpreted as "one or more." Those skilled in the art will recognize that these and other variations are possible within the spirit and scope as defined in the following claims and their equivalents.

What is claimed is:

1. A method comprising:

receiving, at one or more processors of a device, an indication of a first time associated with an alarm clock function;

determining whether the first time differs by more than a threshold amount of time from a plurality of previous times associated with the alarm clock function;

outputting, for display, in response to determining that the first time differs by more than the threshold amount of time from the plurality of previous times, a notification; and enabling the alarm clock function for the first time in response to determining that the first time does not differ by more than the threshold amount of time from the plurality of previous times.

2. The method of claim 1, wherein determining whether the first time differs by more than the threshold amount of time from the plurality of previous times comprises:

determining, from the plurality of previous times, a mean time and a standard deviation;

determining, based on the standard deviation, an amount of time units between the first time and the mean time; and determining whether the amount of time units meets or exceeds the threshold amount of time.

3. The method of claim 2, wherein determining the mean time and the standard deviation comprises:

determining, for each of the plurality of previous times, an amount of time past a predetermined time value.

4. The method of claim 1, wherein outputting the notification for display comprises:

providing a query to confirm an activation of the alarm clock function at the first time; and receiving an indication of input comprising a confirmation of the activation.

5. The method of claim 1, wherein outputting the notification for display comprises:

providing a query to confirm an activation of the alarm clock function at the first time;

receiving an indication of input comprising a request to cancel the activation; and cancelling the activation in response to receiving the request.

6. The method of claim 1, wherein determining whether the first time differs by more than the threshold amount of time from the plurality of previous times comprises:

determining an average amount of time between settings of the plurality of previous times;

determining a difference of time between the first time and when the input indicating the first time was received; and comparing the average amount of time to the difference of time.

7. The method of claim 1, wherein determining whether the first time differs by more than the threshold amount of time from the plurality of previous times comprises:

determining, from each of the plurality of previous times, an associated weekday; and comparing the associated weekday of the plurality of previous times to a weekday associated with the first time.

8. A non-transitory computer readable storage medium storing instructions that cause one or more processor to perform a method, comprising:

identifying, by one or more processors associated with a device, a first time associated with an alarm clock function;

determining whether the first time differs by more than a threshold amount of time from plurality of previous times associated with the alarm clock function;

outputting, for display in response to determining that the first time differs by more than the threshold amount of time from the plurality of previous times, a notification; and enabling the alarm clock function for the first time in response to determining that the first time does not differ by more than the threshold amount of time from the plurality of previous times.

9. The non-transitory computer readable storage medium of claim 8, wherein determining whether the first time differs by more than the threshold amount of time from the plurality of previous times comprises:

determining, from the plurality of previous times, a mean time and a standard deviation;

determining, based on the standard deviation, an amount of time units between the first time and the mean time; and determining whether the amount of time units meets or exceeds the threshold amount of time.

10. The non-transitory computer readable storage medium of claim 9, wherein determining the mean time and the standard deviation comprises:

determining, for each of the plurality of previous times, an amount of time past a predetermined time value.

11. The non-transitory computer readable storage medium of claim 8, wherein outputting the notification comprises:

providing a query to confirm an activation of the alarm clock function at the first time; and receiving an indication of input comprising a confirmation of the activation.

12. The non-transitory computer readable storage medium of claim 8, wherein outputting the notification for display comprises:

providing a query to confirm an activation of the alarm clock function at the first time;

receiving an indication of input comprising a request to cancel the activation; and cancelling the activation in response to receiving the request.

13. The non-transitory computer readable storage medium of claim 8, wherein determining whether the first time differs by more than the threshold amount of time from the plurality of previous times comprises:

determining an average amount of time between one or more settings of the plurality of previous times;

determining a difference of time between the first time and when the input indicating the first time was received; and comparing the average amount of time to the difference of time.

14. The non-transitory computer readable storage medium of claim 8, wherein determining whether the first time differs by more than the threshold amount of time from the plurality of previous times comprises:

determining, from each of the plurality of previous times, an associated weekday; and comparing the associated weekday of the plurality of previous times to a weekday of the first time.

15. A device comprising:

one or more memory devices storing instructions; and one or more processors coupled to the one or more memory devices and configured to execute the instructions to perform a method comprising:

receiving, at the one or more processors, an indication of a first time associated with an alarm clock function;

determining whether the first time differs by more than a threshold amount of time from plurality of previous times associated with the alarm clock function;

outputting, for display, in response to determining that the first time differs by more than the threshold amount of time from the plurality of previous times, a notification; and enabling the alarm clock function for the first time in response to determining that the first time does not differ by more than the threshold amount of time from the plurality of previous times.

16. The device of claim 15, wherein determining whether the first time differs by more than the threshold amount of time from the plurality of previous times comprises:

determining, from a plurality of previous times, a mean time and a standard deviation;

determining, based on the standard deviation, an amount of time units between the first time and the mean time; and determining whether the amount of time units meets or exceeds the threshold amount of time.

17. The device of claim 16, wherein determining the mean time and the standard deviation comprises:

determining, for each of the plurality of previous times, an amount of time past a predetermined time value.

18. The device of claim 15, wherein outputting the notification for display comprises:

providing a query to confirm an activation of the alarm clock function at the first time; and receiving an indication of input comprising a confirmation of the activation.

19. The device of claim 15, wherein outputting the notification for display comprises:

providing a query to confirm an activation of the alarm clock function at the first time;

receiving an indication of input comprising a request to cancel the activation; and cancelling the activation in response to receiving the request.

20. The device of claim 15, wherein determining whether the first time differs by more than the threshold amount of time from the plurality of previous times comprises:

determining an average amount of time between one or more settings of the plurality of one or more previous times;

determining a difference of time between the first time and when the input indicating the first time was received; and comparing the average amount of time to the difference of time.

* * * * *